United States Patent [19]

Tsuzuki

[11] Patent Number: 4,675,592

[45] Date of Patent: Jun. 23, 1987

[54] VOLTAGE OUTPUT CIRCUIT

[75] Inventor: Mitsuo Tsuzuki, Yokohama, Japan

[73] Assignee: Kabushiki Kaisha Toshiba, Kawasaki, Japan

[21] Appl. No.: 726,156

[22] Filed: Apr. 23, 1985

[30] Foreign Application Priority Data

Apr. 26, 1984 [JP] Japan ..... 59-85019

[51] Int. Cl.[4] ..... G05F 3/20

[52] U.S. Cl. ..... 323/313; 323/316

[58] Field of Search ..... 323/311, 312, 313, 316

[56] References Cited

U.S. PATENT DOCUMENTS 3,781,648 12/1973 Owens ..... 323/313

4,258,311 3/1981 Tokuda et al. ..... 323/313

4,339,707 7/1982 Gorecki ..... 323/313

*Primary Examiner*—Peter S. Wong

*Assistant Examiner*—Anita M. Ault

*Attorney, Agent, or Firm*—Finnegan, Henderson, Farabow, Garrett & Dunner

[57] ABSTRACT

Disclosed is a circuit including an NPN transistor of which the collector is connected to a voltage output portion, the emitter is connected to a reference voltage portion, and the base is connected to the voltage output portion through a resistor providing a voltage drop across the base and the voltage output portion, circuit further comprises a pinch resistor connected in parallel to the former-recited resistor to make a reference output voltage Vref of the circuit have a predetermined reference value regardless of a current amplification factor $\beta$ of the output transistor.

2 Claims, 7 Drawing Figures

VOLTAGE OUTPUT CIRCUIT

BACKGROUND OF THE INVENTION

The present invention relates to a voltage output circuit of IC (integrated circuit) structure.

A typical example of the conventional voltage output circuit of IC structure is illustrated in FIG. 1. This circuit is described in "IEEE JOURNAL OF SOLID-STATE CIRCUITS, VOL, SC-6, No. 1 FEBRUARY 1971, PP 1 to 7". The conventional voltage output circuit was developed in use for an integrated one operated at a low voltage.

A voltage ($V_{CC}$) from a power source is applied to a constant current source 11. The output current of constant current source 11 is fed through a resistor R1 to the collector of an NPN transistor Q1. Transistor Q1 and another NPN transistor Q2 are designed to have different current densities. Specifically, a current density of transistor Q2 is approximately 1/10 that of transistor Q1. In this circuit, a voltage drop ΔVBE, which has a positive temperature coefficient, appears across a resistor R3 connected between the emitter of transistor Q2 and the ground providing a reference potential. Further, a voltage drop ΔVBE×R2/R3, which has a positive temperature coefficient, appears across a resistor R2 connected between the collector of transistor Q2 and a voltage output portion 12. In the above mathematical expression, R2 and R3 designate resistors having a resistance denoted by the same reference characters R2 and R3. In this circuit, a voltage VBE3 across the base-emitter path of an output NPN transistor Q3 has a negative temperature coefficient. By such a selection of the temperature coefficients, the temperature coefficient of the reference output voltage Vref is zeroed.

Generally, the output NPN transistors of the circuits have unequal current amplification factors $\beta$ on the technology for manufacturing the circuits. Therefore, output voltages of the circuits are unequal. When the factor $\beta$ is small and a large base current flows, a large voltage drop appears across resistor R2 and a large output voltage Vref appears. On the other hand, when the factor $\beta$ is large and a small base current flows, a small voltage drop appears across resistor R2 and a small output voltage Vref appears. Resistor R2 is made of a base diffusion resistor which has no relation with the current amplification factor $\beta$ of the NPN transistor.

SUMMARY OF THE INVENTION

Accordingly, an object of the present invention is to provide a voltage output circuit of IC structure which produces a reference output voltage of a predetermined reference value regardless of a current amplification factor $\beta$ of an output NPN transistor.

According to the invention, there is provided a voltage output circuit comprising a first resistor, a first NPN transistor, the collector of said transistor being connected to a voltage output portion of the voltage output circuit, the emitter of said transistor being connected to a reference potential portion (Vee), and the base of said transistor being connected to a power source potential through said first resistor causing a voltage drop between said base and said voltage output portion, and a pinch resistor connected across said resistor.

In the present invention, as shown in FIGS. 2 and 3, a pinch resistor R4 is provided at a location in a voltage output circuit where it is influenced by the base current of an output NPN transistor Q3. A value of resistor R4 is proportional to a current amplification factor $\beta$ of transistor Q3. Therefore, the pinch resistors make reference output voltages of the circuits to have a predetermined equal reference value even when the output NPN transistors Q3 in the circuits have unequal current amplification factors $\beta$.

DESCRIPTION OF THE PREFERRED EMBODIMENTS

Preferred embodiments of the present invention will be described referring to the accompanying drawings.

Figure 1:
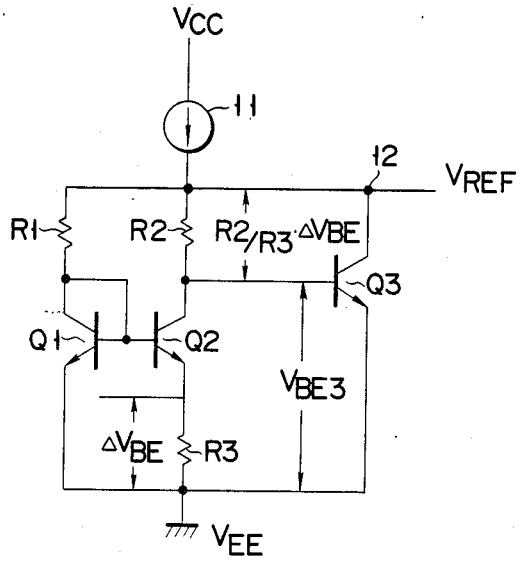
FIG. 1 (PRIOR ART)
FIG. 1 is a circuit diagram showing a conventional reference voltage output circuit.
Figure 2:
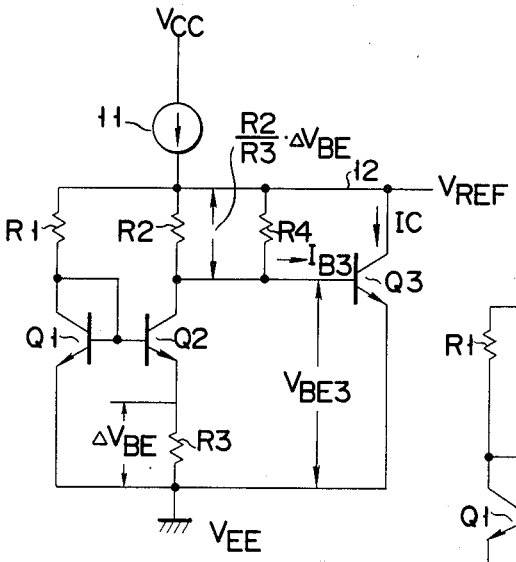
FIGS. 2 and 3 are circuit diagrams showing embodiments of the present invention.

FIG. 2 shows an embodiment of the present invention. The output voltage circuit of the present invention is substantially the same as that of the conventional one of FIG. 1, except that a pinch resistor R4 is connected in parallel to a resistor R2. Pinch resistor R4 provides that a reference output voltage Vref of the circuit has a predetermined reference value regardless of the current amplification factor $\beta$ of output NPN transistor Q3.

In FIG. 2, NPN transistors Q1 and Q2 constitute a current mirror circuit. The collector of transistor Q1 is connected to an output line 12 through a resistor R1. An output voltage Vref appears at output line 12. Output line 12 is connected through a current source 11 to a high potential Vcc as a one power source potential. The collector of transistor Q2 is connected to output line 12 through resistor R2. The emitter of transistor Q1 is connected to a low potential Vee (ground potential $V_{EE}$ in this embodiment) as the other power source potential. The emitter of transistor Q2 is connected to low potential Vee through resistor R3. The bases of transistors Q1 and Q2 are interconnected. The collector and base of transistor Q1 are interconnected. The collector of output NPN transistor Q3 is connected to output line 12. The emitter of transistor Q3 is connected to low potential Vee. The base of transistor Q3 is connected to the collector of transistor Q2. Resistor R2 causes a voltage drop across the collector-base path of transistor Q3. A pinch resistor R4 is connected in parallel to resistor R2. Pinch resistor R4 provides that a reference output voltage Vref of the circuit has a predetermined reference value regardless of the current amplification factor $\beta$ of output NPN transistor Q3. A voltage ($V_{CC}$) from a power source is applied to a constant current source 11. The output current of constant current source 11 is fed through a resistor R1 to the collector of NPN transistor Q1. Transistor Q1 and Q2 are designed to have different current densities. Specifically, a current density of transistor Q2 is approximately 1/10 that of transistor Q1. In this circuit, a voltage drop ΔVBE, which has a positive temperature coefficient, appears across resistor R3 connected between the emitter of transistor Q2 and the ground providing a reference potential. Further, a voltage drop ΔVBE×R2/R3, which has a positive temperature coefficient, appears across a resistor R2 connected between the collector of transistor Q2 and a voltage output 12. In the above mathematical expression, R2 and R3 designate resistors having a resistance denoted by the same reference characters R2 and R3. This is true for other resistors. In this circuit, a voltage VBE3 across the base-emitter path of an NPN transistor Q3 has a negative temperature coefficient. With such a selection of the temperature coefficients, the temperature coefficient of the reference output voltage Vref is zeroed.

Pinch resistor R4 has a resistance substantially proportional to the current amplification factor $\beta$ of transistor Q3 as well known in the IC technical field, and serves as a bypath resistor for the base current of transistor Q3. With the provision of the resistor R4, a reference output voltage Vref of the circuit is made to have a predetermined reference value regardless of the current amplification factor $\beta$ of output NPN transistor Q3.

Figure 4:
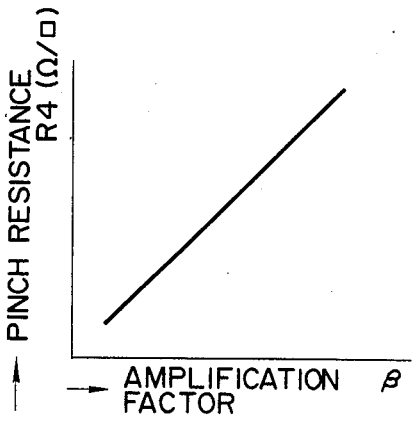
FIG. 4 shows a graph illustrating a relationship of pinch resistance R4 vs., current amplification factor $\beta$.

A relationship between a resistance of resistor R4 and the factor $\beta$ of transistor Q3 is expressed by a direct proportion, as shown in FIG. 4. The resistance of pinch resistor R4 is the measured value in the region where transistor Q3 is unsaturated.

If the collector current of transistor Q3 is substantially constant, i.e., Ic, the base current IB3 is given $$IB3 = Ic/\beta \quad (1)$$

An increment $\Delta VR_2$ of the resistor R2 due to this current is approximately expressed by $$\Delta VR_2 = \frac{Ic}{\beta} \cdot R2 \quad (2)$$

The equation (2) indicates that when the current amplification factor $\beta$ decreases, the voltage increment $\Delta VR_2$ of resistance R2 and the output voltage Vref increases. To compensate for the voltage increment $\Delta VR_2$, pinch resistor R4 is provided parallel with resistor R2, in order to bypass the base current IB3. A resistance of pinch resistor R4 is given by $$R4 = VR2/IB3 \quad (3)$$

where VR2 indicates a voltage drop across resistor R2 if the current IB3 is zero. As seen from FIG. 4, when the factor $\beta$ increases, the temperature increases. Then, current is bypassed through pinch resistance R4, so that the voltage drop across resistor R2 is less varied.

As described above, the resistance R4 of pinch resistance R4 is proportional to the factor $\beta$. Therefore, the product of resistance R4 and the current IB3 is constant. Thus, the voltage drop across resistor R2 is constant regardless of the current amplification factor $\beta$.

The reason why VR4 (R4×IB3) is constant will be given.

$$R4 = K\beta$$

where K is a proportional constant.

$$VR4 = R4 \times IB3$$

-continued (where $VR4$ is a voltage drop across pinch resistor $R4$)

$$= K\beta \times Ic/\beta$$

$$= KIc$$

Since Ic is constant, then VR4 (=R4×IB3) is constant.

Figure 3:
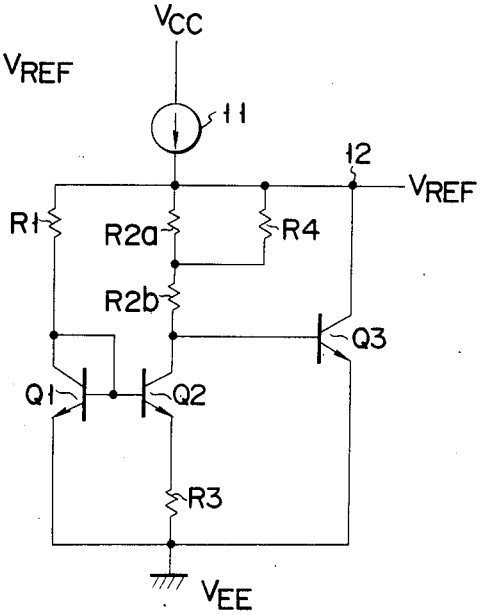

FIG. 3 shows another embodiment of the present invention. In this embodiment, resistor R2 comprises two resistor portions R2*a* and R2*b* connected in series. Resistor portions R2*a* and R2*b* are respectively at the output line side and at the base side of transistor Q3. Resistor portion R2*a* is connected across pinch resistor R4. The remaining circuit portion and the basic operation are substantially the same as those of the first embodiment. Also with the present embodiment, the results are substantially the same in FIG. 2 embodiment. Furthermore, with the present embodiment, resistor R4 can be fabricated smaller in size than that of the first embodiment. Still further, with the present embodiment, the device can operate within a nonsaturated region of the electric current to the voltage.

Figure 5:
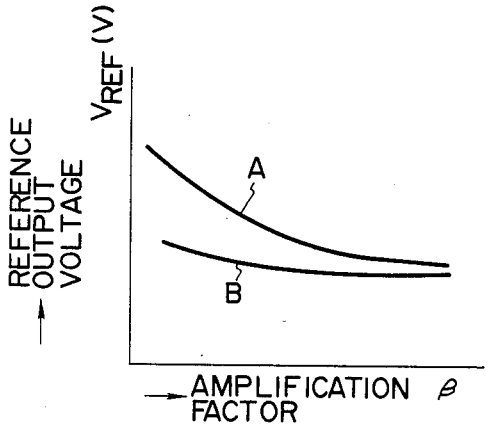
FIG. 5 shows a graph comparatively illustrating relationships of output voltage Vref vs., the amplification factor $\beta$ of the conventional output voltage circuit and that of the present invention.

FIG. 5 comparatively shows Vref−$\beta$ characteristic curves of the prior art and the present invention. In FIG. 5, a curve A shows the characteristic of the prior art, while a curve B shows that of the present invention. As easily seen from the curves, the Vref variation of the present invention is much less than that of the prior art.

Figure 6:
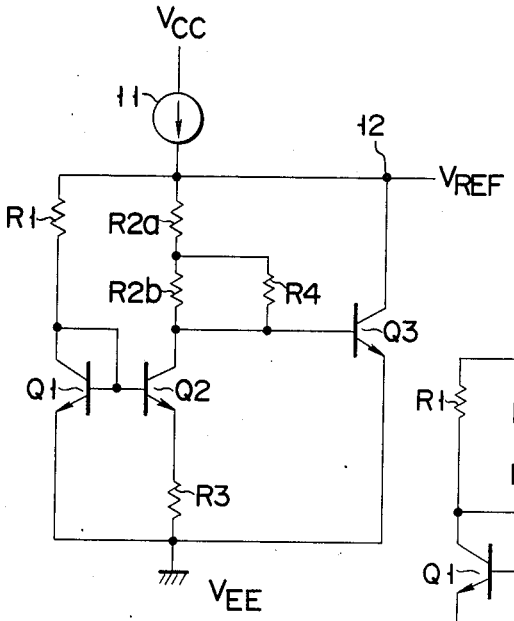
FIGS. 6 and 7 are circuit diagrams showing further embodiments of the present invention.

FIG. 6 shows still another embodiment of the present invention. In this embodiment, resistor R2 comprises two resistor portions R2*a* and R2*b* connected in series. Resistor portions R2*a* and R2*b* are respectively at the output line side and at the base side of transistor Q3. Resistor portion R2*b* is connected across pinch resistor R4. The remaining circuit portion and the basic operation are substantially the same as those of the first or second embodiment. Also with the present embodiment, the results are substantially the same in FIG. 2 embodiment.

Figure 7:
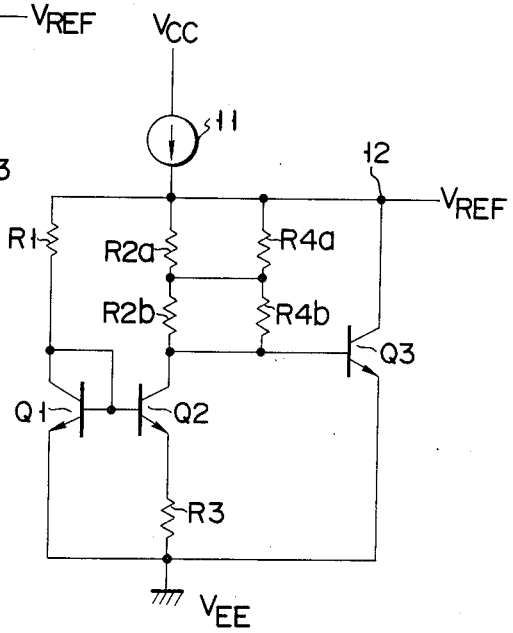

FIG. 7 shows a further embodiment of the present invention. In this embodiment, resistor R2 comprises two resistor portions R2*a* and R2*b* connected in series. Resistor portions R2*a* and R2*b* are respectively at the output line side and at the base side of transistor Q3. Pinch resistor R4 also comprises two pinch resistor portions R4*a* and R4*b* connected in series. Pinch resistor portions R4*a* and R4*b* are respectively at the output line side and at the base side of transistor Q3. Pinch resistor portion R4*a* crosses resistor portions R2*a* and pinch resistor portion R4*b* crosses resistor portion R2*b*, respectively. The remaining circuit portion and the basic operation are substantially the same as those of the respective embodiments. Also with this embodiment, the results are substantially the same in FIG. 2 embodiment. Furthermore, with the present embodiment, the device can operate within a nonsaturated region of the electric current to the voltage.

As described above, according to the present invention, there is provided a circuit comprising an output NPN transistor of which the collector is connected to a voltage output portion, the emitter is connected to a reference voltage portion, and the base is connected to the voltage output portion through a resistor causing a voltage drop across the base and the voltage output portion, and a pinch resistor connected in parallel to the former-recited resistor. The pinch resistors make the output voltages of the circuits to have a predetermined equal reference value when the output transistors in the circuits have unequal current amplification factors $\beta$.

What is claimed is:

1. A voltage output circuit comprising:

a current source having a first terminal connected to a power source potential and a second terminal directly connected to a circuit point at which an output voltage appears;

a first resistor having one terminal directly connected to said circuit point;

a second resistor comprising two divided resistor portions connected in series;

a third resistor;

first and second NPN transistors whose bases are interconnected, the collector of said first transistor being connected to said circuit point through said first resistor, the emitter of said first transistor being connected to a reference potential, the collector of said second transistor being connected to said circuit point through said second resistor, and the emitter of said second transistor being connected through said third resistor to said reference potential;

a third NPN transistor whose base is connected to the collector of said second transistor, the collector of said third transistor being connected to said circuit point, and the emitter of said third transistor being connected to a reference potential; and a pinch resistor connected in parallel to one of said two resistor portions of said second resistor.

2. A voltage output circuit comprising:

a current source connected between a power source potential and a circuit point at which an output voltage appears;

a first resistor;

a second resistor comprising two divided second resistor portions connected in series;

a third resistor;

first and second NPN transistors whose bases are interconnected, the collector of said first transistor being connected to said circuit point through said first resistor, the emitter of said first transistor being connected to a reference potential, the collector of said second transistor being connected to said circuit point through said second resistor, and the emitter of said second transistor being connected through said third resistor to said reference potential;

a third NPN transistor whose base is connected to the collector of said second transistor, the collector of said third transistor being connected to said circuit point, and the emitter of said third transistor being connected to a reference potential; and a pinch resistor comprising two divided pinch resistor portions connected in series, each of said pinch resistor portions being connected in parallel to a different one of said second resistor portions.

* * * * *